US007536992B1

(12) United States Patent
Wieshuber et al.

(10) Patent No.: US 7,536,992 B1
(45) Date of Patent: May 26, 2009

(54) ENGINE SPEED CONTROLLER HAVING PI GAINS SET BY ENGINE SPEED AND ENGINE SPEED ERROR

(75) Inventors: Paul A. Wieshuber, River Grove, IL (US); James T. Beaucaire, Wheaton, IL (US); Michael A. Majewski, Joliet, IL (US)

(73) Assignee: International Engine Intellectual Property Company, LLC, Warrenville, IL (US)

( * ) Notice: Subject to any disclaimer, the term of this patent is extended or adjusted under 35 U.S.C. 154(b) by 0 days.

(21) Appl. No.: 12/056,864

(22) Filed: Mar. 27, 2008

(51) Int. Cl.
*F02D 31/00* (2006.01)
*F02D 41/08* (2006.01)
*F02D 41/10* (2006.01)
*F02M 3/08* (2006.01)

(52) U.S. Cl. ..... 123/352; 123/339.19; 123/339.21; 701/110

(58) Field of Classification Search ..... 123/350, 123/352, 339.19, 339.21; 701/110
See application file for complete search history.

(56) References Cited

U.S. PATENT DOCUMENTS 4,780,827 A * 10/1988 Fujimori et al. ..... 701/110
5,213,077 A * 5/1993 Nishizawa et al. ..... 123/352
5,329,455 A * 7/1994 Oo et al. ..... 701/93
5,420,793 A * 5/1995 Oo et al. ..... 701/93
5,669,351 A * 9/1997 Shirai et al. ..... 123/339.21
5,740,045 A * 4/1998 Livshiz et al. ..... 701/101
6,009,852 A * 1/2000 Akabori et al. ..... 123/339.19
6,164,265 A * 12/2000 Yip et al. ..... 123/339.21
6,289,873 B1 * 9/2001 Dunsworth ..... 123/352
6,935,306 B2 * 8/2005 Surnilla et al. ..... 123/339.11
2004/0074473 A1 * 4/2004 Okubo et al. ..... 123/339.23
2005/0257770 A1 * 11/2005 Nakahara et al. ..... 123/339.19

* cited by examiner

*Primary Examiner*—Erick Solis
(74) *Attorney, Agent, or Firm*—Jack D. Nimz; Jeffrey P. Calfa

(57) ABSTRACT

A PI control strategy controls engine speed to an engine speed set-point. A proportional map (36) is populated with data values to be used in calculating the P component of the strategy. An integral map (38) is populated with data values to be used in calculating the I component. Each data value in the maps is correlated with a speed data value representing engine speed (N) and a speed error data value representing the difference between engine speed and engine speed set-point (N_DIF_MAX_LIM). Values for proportional and integral components are selected from the respective maps by processing current engine speed data and current engine speed error data. The strategy uses the values from the maps for controlling engine speed to the speed set-point. Data values from other maps (20 and 24; or 22 and 26) modify the selected values from the proportional and integral maps (36, 38) for transmission type, transmission gear, and engine temperature.

17 Claims, 2 Drawing Sheets

ENGINE SPEED CONTROLLER HAVING PI GAINS SET BY ENGINE SPEED AND ENGINE SPEED ERROR

FIELD OF THE INVENTION

This invention relates generally to internal combustion engines, especially compression ignition engines that propel large motor vehicles. More particularly it relates to an engine controller that has a PI (proportional/integral) control strategy for securing correspondence of engine speed to a speed set-point that at times may be engine high idle speed and at other times may be a request from a different controller to limit engine speed.

BACKGROUND OF THE INVENTION

A known electronic engine control system comprises a processor-based controller that processes data from various sources to develop control data for controlling certain aspects of engine operation such as speed and output torque. Control of speed and output torque of a diesel engine is in large part accomplished by controlling how the engine is fueled, but also in conjunction with control of other factors that include engine boost and back pressure, exhaust gas recirculation (EGR), and in an engine equipped with variable valve timing, even compression ratio.

Control of engine fueling comprises controlling the quantity of fuel injected into an engine cylinder during a fuel injection and controlling the timing of the injection. State-of-the-art fuel injector systems and associated electronics enable engine fueling to be controlled with precision. The other factors mentioned above can also be controlled with precision through the use of state-of-the-art devices and associated electronics.

While control of individual devices, like fuel injectors, EGR valves, or turbocharger vanes for example, can be accomplished with precision, the cumulative effect of controlling each individual device when the engine is in a dynamic state of operation may at times tend to cause temporary disturbances such as transient oscillations, perturbations, overshoots, and the like, in certain operating parameters like engine speed and torque. It is of course desirable that such disturbances be avoided, or at least minimized, not only for the sake of engine performance, but also because they may have adverse consequences on tailpipe emissions.

A diesel engine controller is typically calibrated with set-point values for certain parameters that characterize the engine and how it should be operated. One such parameter is engine high idle speed. High idle speed is the maximum engine speed that the controller will allow and at that speed, flywheel torque is zero, meaning that the controller is causing the engine to run at that speed while developing only enough torque to overcome friction and pumping losses so that no output torque is available at the flywheel. Typical high idle speeds for diesel engines used in trucks are in the range from about 2,000 rpm to about 3,000 rpm. It is important for an engine controller to assure that engine operation doesn't exceed high idle speed.

A known controller for engine speed uses a PI (proportional-integral) control strategy whose intent is to secure faithful correspondence of engine speed to an engine speed set-point that can have any value within the engine's speed range. When engine high idle becomes the set-point, it is important that the controller keep engine speed from exceeding the set-point.

It has been discovered engine speed may not always be controlled with repeatable accuracy in certain situations and that some instability and/or loss of accuracy may become noticeable. One example of this was observed in an engine whose high idle set-point changed as a function of transmission gear selection in an automatic transmission equipped vehicle.

During operation of a vehicle on the road, assured limiting of engine speed by the engine controller becomes especially important when a controller other than the engine controller is requesting that engine speed be limited. Transmission, ABS, and traction controllers that interact with an engine controller are examples of such other controllers.

SUMMARY OF THE INVENTION

The present invention relates to an improvement in the PI (proportional-integral) control strategy for ameliorating, and ideally eliminating, observed inconsistencies, instabilities, and loss of accuracy in situations when engine speed is being limited by the engine controller, either on its own initiative or when acting on a speed limiting request from an associated controller like those mentioned before. The improvement provides noticeably better regulation of engine speed at high idle and at low speeds where high torque must be delivered, such as at vehicle launch.

The invention is based in part on the inventors' recognition that an engine has different responses depending on where it is operating along a particular torque curve. Instead of relying on a fixed gain for the proportional control term and a fixed gain for the integral control term in the known controller referred to above, the present invention comprises the use of respective maps, or tables, populated respectively by different values for use in calculating the proportional term gain and the integral term gain that are correlated with engine speed and engine speed error, the latter being the difference between current engine speed and the speed set-point value, which in the case of high idle speed, would be the high idle speed set-point value.

The use of such maps can provide larger gains that are needed at certain engine speeds, even if the error has not become very large. That allows added protection against overshooting a target speed, such as when the set-point is changed to a lower speed, for example when a "locked in first gear" option becomes active.

The use of such maps can also provide the smaller gains that promote engine speed stability when the speed is close to the set-point (i.e. when the error is small).

Recognizing that an engine operates differently when warming from cold start than when fully warmed, the inventors also provide gain maps populated with gains based on engine temperature, as measured by either engine oil temperature or engine coolant temperature.

Because of the recognition that automatic and manual transmissions have different acceleration rates each of which requires the engine to have a somewhat different control strategy, different sets of gain maps are provided, one set to be used when the engine is in a vehicle that has an automatic transmission and another set to be used in a vehicle having a manual transmission.

The conjunctive use of these maps promotes better speed limiting under changing engine operating conditions and more consistent, more precise high idle performance.

By continuing use of the basic engine speed limiter strategy when a speed limit request is received, but now using engine speed and speed error to set P and I gains, engine calibrators are given significant flexibility in tuning an engine so that the engine will respond in a desired way.

The invention improves upon the functionality of the basic speed limiter by enabling it to respond more like a full feedback speed governor, such as one that has previously been used in commercial International I-6 engines. The improvement is achieved without the significant time and expense that would have been required to re-design the controller to incorporate a full feedback controller for high idle control, and from earlier discussion, the reader can appreciate that the improved basic speed limiter also responds to speed limit requests from other controllers. For example, accurate engine speed limit control is important for an automated manual transmission at clutch engagement and for an ABS/traction controller when active.

When the maps are properly populated by engine calibrators, the inventive controller is able to run the engine at a stable high idle speed that avoids undesired occurrences of engine bounce against a rev limiter. It provides little or no overshoot of the maximum high idle set-point, an important consideration from the standpoint of vehicle NVH. The inventive controller assures stability and accuracy of engine speed at high idle, avoiding undesired torque surges.

Because the improved NVH is a consequence of the inventive controller's ability to achieve more stable speed control and to avoid significant overshooting of a target speed, significant cost savings have been realized by the elimination of engine sound shields and certain crankcase reinforcements previously needed for noise level compliance.

The invention also allows certain automated manual transmissions to be used with existing engines, a use that was heretofore avoided because of concerns about the engine controller's ability to perform stable and accurate speed limiting.

An automated manual transmission is a manual transmission that is controller-shifted using a servo motor. Clutching is performed by an internal centrifugal clutch that is freewheeling when the engine idles, but begins to engage and transfer torque as the engine accelerates, and eventually lock. To control the rate of engagement, the transmission controller sends a "speed limit" command over the CAN using a standard J1939 message Override Control Mode 3—Speed Limit.

For example the transmission may sends successive speed limits of 720 rpm, 740 rpm, and 760 rpm. The rate of change of the limit controls the engagement rate of the clutch. The task of engaging the clutch is somewhat delicate because too fast an engagement can cause oscillations throughout the driveline, and too slow an engagement can cause loss of performance.

The inventors have recognized that because the known basic engine speed limiter controls engine speed both at clutch engagement and at high idle, tuning it for smooth, zero torque output at high idle fails to provide the performance that is needed at low engine speeds when the clutch is being engaged to transmit the large torque needed to accelerate the vehicle, and similarly, tuning it to the transmission for best clutch engagement at low-speed, high-torque has an adverse effect on high idle performance. The improvement provided by the present invention provides desired speed regulation at both extremes.

Accordingly a generic aspect of the invention relates to an internal combustion engine comprising a control system for processing certain data according to a PI control strategy for controlling engine speed to an engine speed set-point.

The control system comprises a proportional map populated with data values for use in calculating the P component of the control strategy and an integral map populated with data values for use in calculating the I component of the control strategy.

Each data value in the proportional map is correlated with a set of data values, a first of which is a speed data value representing engine speed and a second of which is an error data value representing the difference between engine speed and the engine speed set-point.

Each data value in the integral map is correlated with a set of data values, a first of which is the speed data value representing engine speed and a second of which is the speed error data value representing the difference between engine speed and the engine speed set-point.

The control system operates to select a data value from each map by processing current engine speed data and current speed error data and to cause the PI control strategy to use the selected data values in calculations for controlling engine speed to the engine speed set-point.

Another generic aspect relates to a vehicle that is propelled by the engine just described.

Still another generic aspect relates to the method that is performed by the engine just described.

The foregoing, along with further features and advantages of the invention, will be seen in the following disclosure of a presently preferred embodiment of the invention depicting the best mode contemplated at this time for carrying out the invention. This specification includes drawings, now briefly described as follows.

DESCRIPTION OF THE PREFERRED EMBODIMENT

Figure 1:
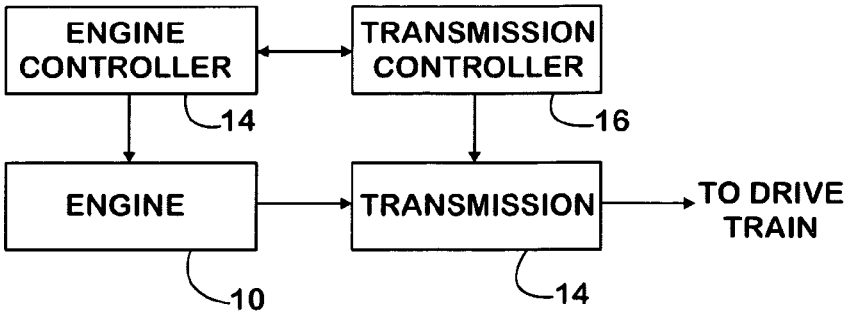
FIG. 1 is a general schematic diagram of a portion of a motor vehicle applicable to the present invention.

FIG. 1 shows a portion of the powertrain of a truck comprising a diesel engine 10 and a transmission 12 that couples the engine flywheel through a drivetrain to driven wheels.

A processor-based engine controller 14 that is part of an engine control system processes data from various sources to develop various control data for controlling various aspects of engine operation. The data processed by controller 14 may originate at external sources, such as sensors, and/or be generated internally.

A processor-based transmission controller 16 is associated with transmission 14. The two controllers 14, 16 are able to communicate with each other via an on-board communication network in the truck.

Figure 2:
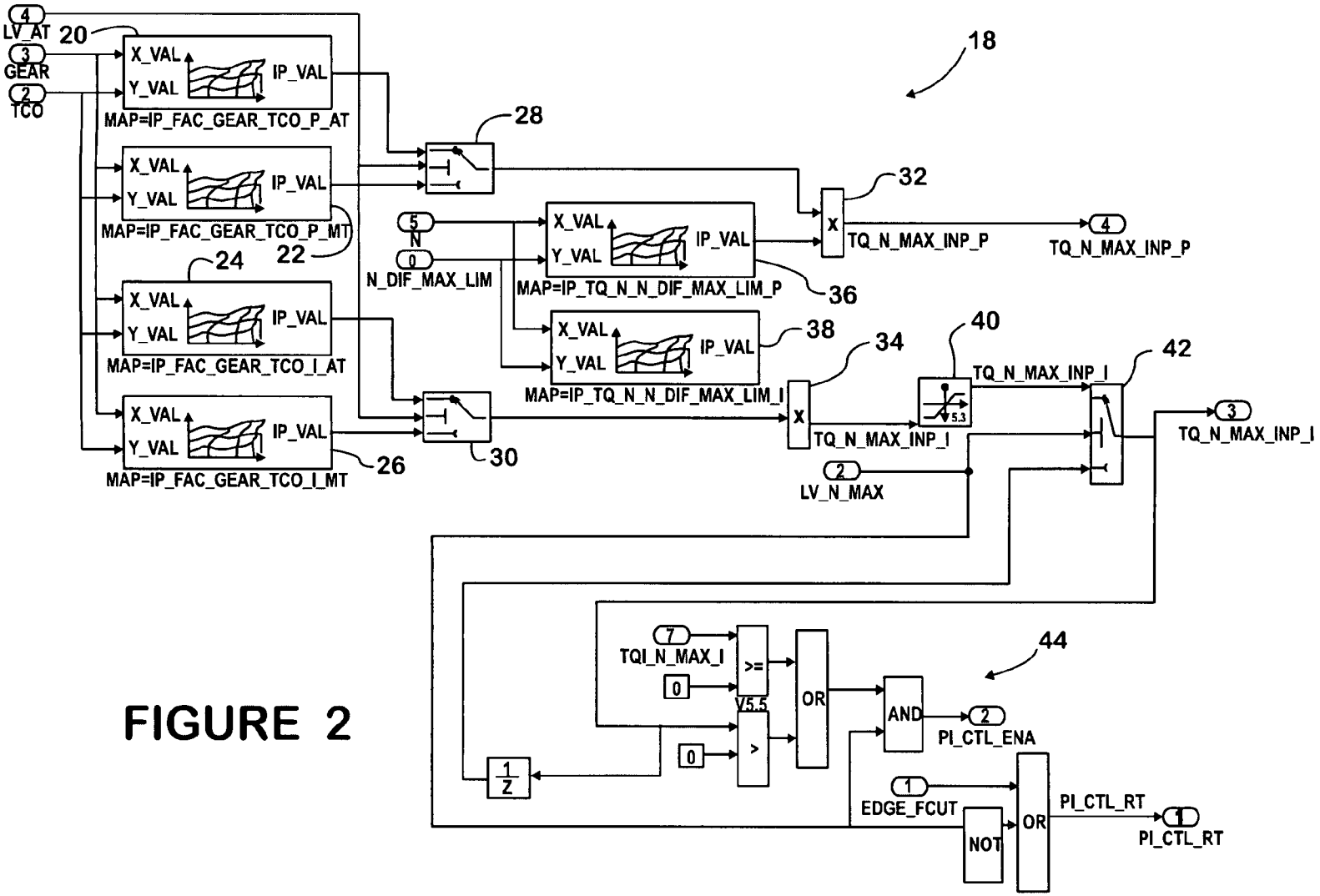
FIG. 2 is a schematic software strategy diagram of an exemplary embodiment of engine speed control strategy according to the present invention.

Engine controller 14 comprises the inventive engine speed control strategy 18 that is shown in FIG. 2.

FIG. 2 shows four two-dimensional maps 20, 22, 24, and 26. Each map is populated with values, each of which is correlated with a temperature data value representing engine temperature (TCO) and with a transmission gear data value (GEAR) representing the gear in which transmission 14 has been placed. TCO and GEAR are data values that are processed by controller 14 to select a particular one of the values from the maps corresponding to the particular data values for TCO and GEAR. Both maps 20 and 22 are proportional maps populated with gain data values for calculating gain to be applied to the P component of the control strategy. Both maps 24 and 26 are proportional maps populated with gain data values for calculating gain to be applied to the I component of the control strategy.

Switch functions 28, 30 control which selected gain data values will be further used in the inventive strategy. Switch functions 28, 30 normally pass the gain data values selected from maps 22, 26. The gain data values in those maps have been developed for a vehicle that has a particular manual transmission. When a particular automated manual transmission replaces the manual transmission, a programmed parameter LV_AT changes from false to true causing functions 28, 30 to pass the selected gain values from maps 20, 24 instead of those from maps 22, 26. The gain data values in those maps 20, 24 have been developed for the automated manual transmission.

The gain data value passed by switch function 28 becomes a factor for a multiplication function 32. The gain data value passed by switch function 30 becomes a factor for a multiplication function 34.

The other factor for multiplication function 32 is provided by a map 36 while the other factor for multiplication function 34 is provided by a map 38. Map 36 is a map populated with data values that are based on engine speed and size of engine speed error and are used in conjunction with the gain data value that is being applied to multiplication function 32 from the selected one of maps 20 and 22. Map 38 is a map populated with data values that are based on engine speed and size of engine speed error and are used in conjunction with the gain data value that is being applied to multiplication function 34 from the selected one of maps 24 and 26.

Each data value in map 36 is correlated with a set of data values, a first of which is a speed data value representing engine speed and a second of which is a speed error data value representing the difference between engine speed and the engine speed set-point.

Each data value in map 38 is correlated with a set of data values, a first of which is a speed data value representing engine speed and a second of which is a speed error data value representing the difference between engine speed and the engine speed set-point.

The data value of a parameter (N) represents engine speed. The data value of a parameter (N_DIF_MAX_LIM) represents speed error, meaning the difference between current engine speed and the current engine speed set-point.

Control system 14 operates to select a data value from each map 36, 38 by processing current engine speed data (N) and current engine speed error data (N_DIF_MAX_LIM) and to cause the PI control strategy to use the respective selected data values from the two maps to multiply the respective data values passed by switch functions 28 and 30 for controlling engine speed to the engine speed set-point. The PI control strategy seeks to constantly reduce the speed error to zero thereby securing faithful correspondence of engine speed to engine speed set-point, even as the latter changes. While the use of proportional and integral control using constants for the respective gains in a closed feedback loop is a known strategy, the use of maps 36, 38 to enable gains to be tailored to specific points of operation of the engine along speed-torques curves provides much improved response throughout a speed torque plot for an engine. The use of two sets of maps 20, 24 and 22, 26 tailors a generic controller for potential use with two different transmissions while also providing temperature-based gain adjustment.

Multiplication function 36 multiplies the two factors applied to it to develop a data value for the proportional term of the PI strategy. The result is a parameter (TQ_N_MAX_INP_P). Multiplication function 38 multiplies the two factors applied to it to develop a data value for the integral term of the PI strategy. The result is a parameter (TQ_N_MAX_INP_I), which is subject to a function 40 which limits the parameter's value to a range between a maximum and a minimum value.

A switch function 42 controlled by a parameter LV_N_MAX substitutes a sub-strategy 44 for the integral gain to be used for PI control. Sub-strategy 44 processes the interim torque value of the controller (TQI_N_MAX_1) and the I term gain factor (TQ_N_MAX_INP_I). If both are less than or equal to 1, the I term gain factor is set to 0 and passed on to the integrator. This turns off the integral portion of the controller to prevent large negative values from being used for the integral gain.

Figure 3:
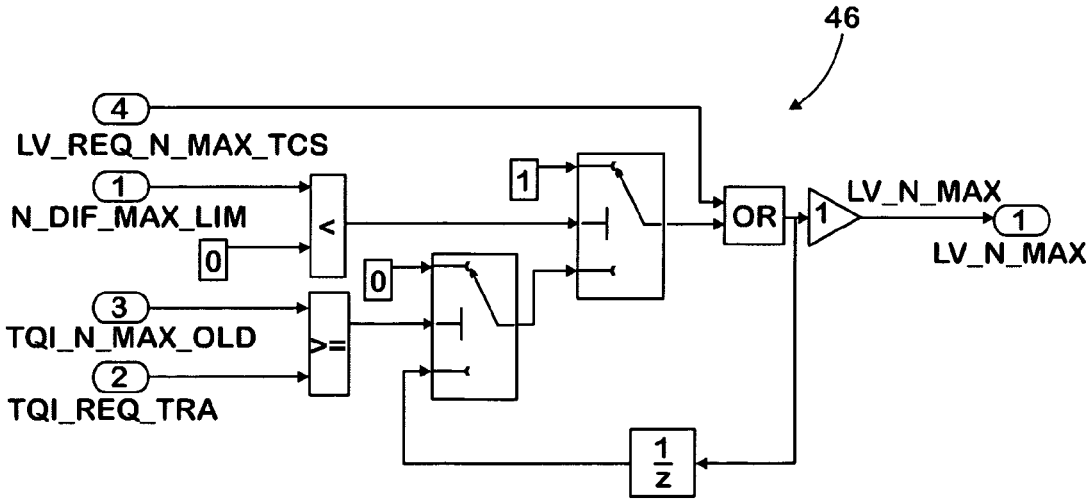
FIG. 3 is a related software strategy diagram.

The data value for LV_N_MAX is developed by a sub-strategy 46 shown in FIG. 3. Sub-strategy 46 turns the controller on based on the error to the speed control set-point (N_D_F_MAX_LIM) or if the traction controller is requesting a maximum engine speed (LV_REQ_N_MAX_TCS). For stability, hysteresis is used to turn off sub-strategy 46.

While a presently preferred embodiment of the invention has been illustrated and described, it should be appreciated that principles of the invention apply to all embodiments falling within the scope of the following claims.

What is claimed is:

1. An internal combustion engine comprising:

a control system for processing certain data according to a PI control strategy for controlling engine speed to an engine speed set-point;

the control system comprising a proportional map populated with data values to be used in calculating the P component of the control strategy and an integral map populated with data values to be used in calculating the I component of the control strategy;

each data value in the proportional map being correlated with a set of data values, a first of which is a speed data value representing engine speed and a second of which is a speed error data value representing the difference between engine speed and the engine speed set-point;

each data value in the integral map being correlated with a set of data values, a first of which is a speed data value representing engine speed and a second of which is a speed error data value representing the difference between engine speed and the engine speed set-point; and wherein the control system operates to select a data value from each map by processing current engine speed data and current engine speed error data and to cause the PI control strategy to use the selected data values from the maps in calculations for controlling engine speed to the engine speed set-point.

2. An engine as set forth in claim 1 including a set of gain maps each populated with gain data values for modifying the data values selected from the proportional and integral maps, and wherein the control system operates to process data values selected from the gain maps and the data values selected from the proportional and integral maps to cause the PI control strategy to use the selected data values from the gain maps in conjunction with the selected data values from the proportional and integral maps in calculations for controlling engine speed to the engine speed set-point.

3. An engine as set forth in claim 2 wherein the control system operates to select the gain data values by processing a data value representing engine temperature.

4. An engine as set forth in claim 2 wherein the control system operates to select the gain data values by processing a data value representing the selected gear in which a transmission with which the engine is to be used in a particular vehicle is placed.

5. An engine as set forth in claim 2 wherein the control system operates to select the gain data values by processing a data value representing the selected gear in which a transmission with which the engine is to be used in a particular vehicle is placed and also by processing a data value representing engine temperature.

6. An engine as set forth in claim 2 further including a second set of gain maps, and wherein the control system operates to select one set of gain maps to the exclusion of the other for use in modifying the selected data values from the proportional and integral maps, the gain map selection being based on the particular transmission with which the engine is to be used in a particular vehicle.

7. An engine as set forth in claim 6 wherein the control system operates to select the gain data values by processing both a data value representing the selected gear in which the particular transmission is placed and a data value representing engine temperature.

8. A method for securing correspondence of speed of an internal combustion engine to an engine speed set-point, the method comprising:

processing certain data according to a proportional/integral control strategy for controlling engine speed to the engine speed set-point;

using current engine speed and engine speed error to select from a proportional map populated with data values each correlated with a particular engine speed data value representing engine speed and with a particular speed error data value representing the difference between engine speed and the engine speed set-point;

using current engine speed and engine speed error to select from an integral map populated with data values each correlated a particular speed data value representing engine speed and a particular speed error data value representing the difference between engine speed and the engine speed set-point;

and causing the PI control strategy to use the selected gain data values from the maps in calculations for controlling engine speed to the engine speed set-point.

9. A method as set forth in claim 8 including selecting gain data values from a set of gain maps each populated with gain data values for modifying the data values selected from the proportional and integral maps, and processing data values selected from the gain maps and the data values selected from the proportional and integral maps to cause the PI control strategy to use the selected data values from the gain maps in conjunction with the selected data values from the proportional and integral maps in calculations for controlling engine speed to the engine speed set-point.

10. A method as set forth in claim 9 wherein the step of selecting gain data values from the set of gain maps comprises processing a data value representing engine temperature.

11. A method as set forth in claim 9 wherein the step of selecting modifier data values from the set of gain maps comprises processing a data value representing the selected gear in which a transmission that is coupled to the engine is placed.

12. A method as set forth in claim 9 wherein the step of selecting gain data values from the set of gain maps comprises processing both a data value representing the selected gear in which a transmission that is coupled to an engine is placed and a data value representing engine temperature.

13. A motor vehicle comprising:

a powertrain that comprises an internal combustion engine coupled through a transmission to a drivetrain for propelling the vehicle;

a control system for processing certain data according to a PI control strategy for controlling engine speed to an engine speed set-point;

the control system comprising a proportional map populated with data values to be used in calculating the P component of the control strategy and an integral map populated with data values to be used in calculating the I component of the control strategy;

each data value in the proportional map being correlated with a set of data values, a first of which is a speed data value representing engine speed and a second of which is a speed error data value representing the difference between engine speed and the engine speed set-point;

each data value in the integral map being correlated with a set of data values, a first of which is a speed data value representing engine speed and a second of which is a speed error data value representing the difference between engine speed and the engine speed set-point; and wherein the control system operates to select a data value from each map by processing current engine speed data and current speed error data and to cause the PI control strategy to use the selected data values in calculations for controlling engine speed to the engine speed set-point.

14. A motor vehicle as set forth in claim 13 including a set of gain maps each populated with gain data values for modifying the data values selected from the proportional and integral maps, and wherein the control system operates to process data values selected from the gain maps and the data values selected from the proportional and integral maps to cause the PI control strategy to use the selected data values from the gain maps in conjunction with the selected data values from the proportional and integral maps in calculations for controlling engine speed to the engine speed set-point.

15. A motor vehicle as set forth in claim 14 wherein the control system operates to select the gain data values by processing a data value representing engine temperature.

16. A motor vehicle as set forth in claim 14 wherein the control system operates to select the gain data values by processing a data value representing the selected gear in which the transmission is placed.

17. A motor vehicle as set forth in claim 14 wherein the control system operates to select the gain data values by processing both a data value representing the selected gear in which the transmission is placed and a data value representing engine temperature.

* * * * *